US005158427A

United States Patent [19]

Shirai

[11] Patent Number: 5,158,427

[45] Date of Patent: Oct. 27, 1992

[54] CENTRIFUGAL SUPERCHARGER

[75] Inventor: Makoto Shirai, Toyohashi, Japan

[73] Assignee: Aisin Seiki Kabushiki Kaisha, Kariya, Japan

[21] Appl. No.: 713,278

[22] Filed: Jun. 11, 1991

[30] Foreign Application Priority Data

Jun. 15, 1990 [JP] Japan ..... 2-158516

[51] Int. Cl.[5] ..... F01D 11/00

[52] U.S. Cl. ..... 415/110; 415/122.1; 277/67

[58] Field of Search ..... 415/110, 111, 112, 122.1, 415/122.4; 277/67, 133

[56] References Cited

U.S. PATENT DOCUMENTS

| | | | |
|---|---|---|---|
| 2,729,106 | 1/1956 | Mathiesen | 415/112 |
| 2,826,937 | 3/1958 | Ochtman | 415/122.1 |
| 4,830,572 | 5/1989 | Oklejas, Jr. et al. | 415/110 |
| 4,936,742 | 6/1990 | Eguchi et al. | 415/111 |

FOREIGN PATENT DOCUMENTS 60-38028 11/1985 Japan .

OTHER PUBLICATIONS

Japanese Magazine Motor Fan, Dec. 12, 1989 pp. 45–48, vol. 43, No. 12.

*Primary Examiner*—John T. Kwon

*Attorney, Agent, or Firm*—Oblon, Spivak, McClelland, Maier & Neustadt

[57] ABSTRACT

A centrifugal supercharger includes a housing, an input shaft rotatably supported on the housing, a pulley related with one end of the input shaft, an output shaft rotatably supported on the housing, a compressor rotor fixed to one end of the output shaft, a cover located around the compressor rotor, and fixed to the housing, and forming a supercharging passage, an rotating speed step-up device connecting between other end of the input shaft and other end of the output shaft, an oil-supplying device integrated with the step-up device, and a distributing device faced with the oil-supplying device, and formed on the housing.

6 Claims, 6 Drawing Sheets

CENTRIFUGAL SUPERCHARGER

BACKGROUND OF THE INVENTION

1. Field of the Invention:

The present invention relates to a centrifugal supercharger and more particularly to a centrifugal supercharger for an engine of a motorcar.

2. Description of the Related Art:

A conventional centrifugal supercharger 70, as shown in FIG. 6, is disclosed in Japanese Magazine "Motor Fan" for December, 1989. In the centrifugal supercharger 70, pulleys 71*a*, 71*b* which are driven by an engine (not shown) drive pulleys 72*a*, 72*b* via a belt 80. The pulleys 71*a*, 71*b*, 72*a*, 72*b* and belt 80 compose a CVT (continuous variable transmission) 79 which is known in general.

The pulleys 72*a*, 72*b* are rotatably supported on a shaft 74. A plate 81 is fixed to the shaft 74, and is connected with or parted from the right side of the pulley 72*b* by action of an electromagnetic coil 73. The shaft 74 and a shaft 76 are rotatably supported on a housing 82. A compressor rotor 77 is fixed on the right end of the shaft 76, and is located in an intake passage 78 of the engine.

The shaft 76 is connected with the shaft 74 via a rotating speed step-up or accelerating device 75. Planetary gears 83*a*, 83*b* are rotatably supported on shafts 84*a*. 84*b* fixed on the housing 82. An outer member 85 is fixed to the right end of the shaft 74, and has an inner gear meshed with the gears 83*a*, 83*b*. An inner member 86 is fixed to the left end of the shaft 76, and has an outer gear meshed with the gears 83*a*, 83*b*. So, the revolution of the outer member 85 is transmitted to the revolution of the inner member 86 with acceleration by planetary gears 83*a*, 83*b*.

The needed revolution of the compressor rotor 77 is about 200,000 ~300,000 r.p.m. in maximum, and gears are used in the accelerating device 75. So, the noise generated at the gears is very large. Further, the oil for lubricating the gears is stripped off from the gears by centrifugal force. So, the lubricating effect does not act for the gears.

SUMMARY OF THE INVENTION

Accordingly, it is a primary object of the present invention to reduce the noise generated in the centrifugal supercharger.

Further, it is another object of the present invention to get a good lubricating effect in the centrifugal supercharger.

The above and other objects are achieved according to the present invention by a centrifugal supercharger which comprises a housing, an input shaft rotatably supported on the housing, a pulley related with one end of the input shaft, an output shaft rotatably supported on the housing, a compressor rotor fixed to one end of the output shaft, a cover located around the compressor rotor, and fixed to the housing, and forming a supercharging passage, an accelerating or rotating speed step-up device connecting between other end of the input shaft and other end of the output shaft, an oil-supplying device integrated with the accelerating device, and a distributing device faced with the oil-supplying device, and formed on the housing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE INVENTION

Figure 1:
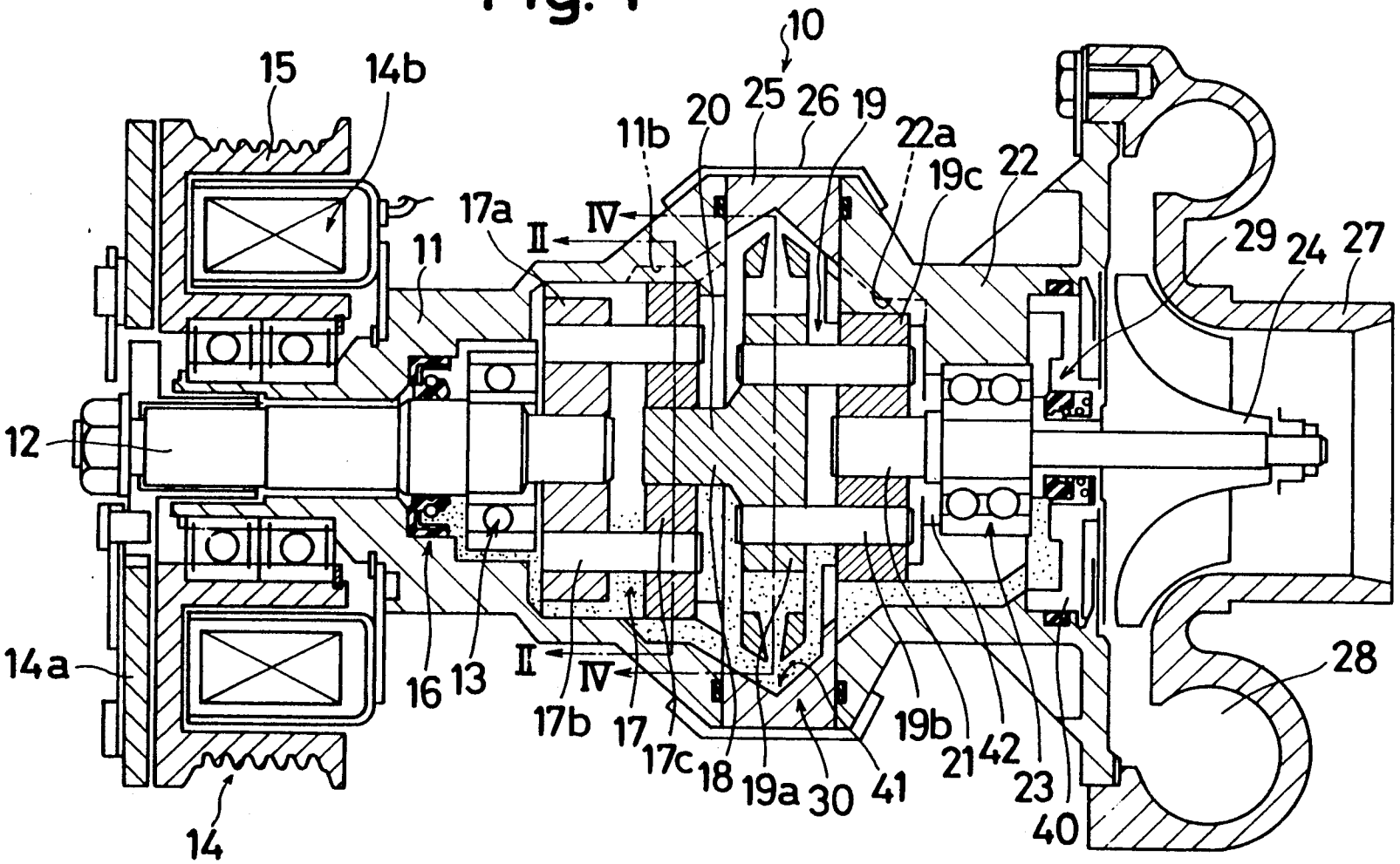
FIG. 1 is a cross-sectional view of a centrifugal supercharger according to the invention.
Figure 5:
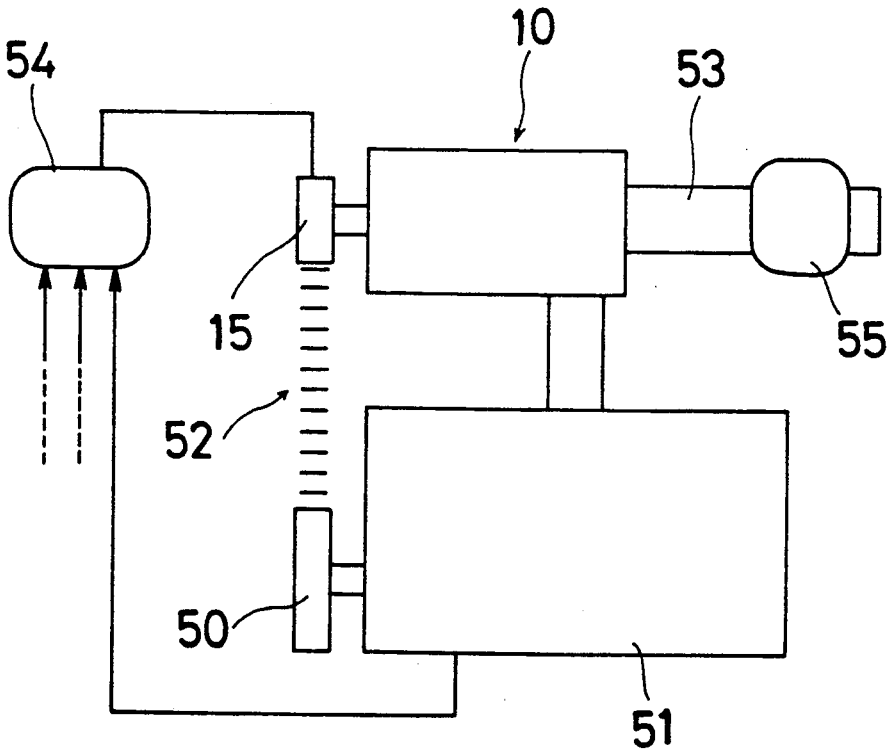
FIG. 5 is a block diagram of the centrifugal supercharger according to the invention.
Figure 6:
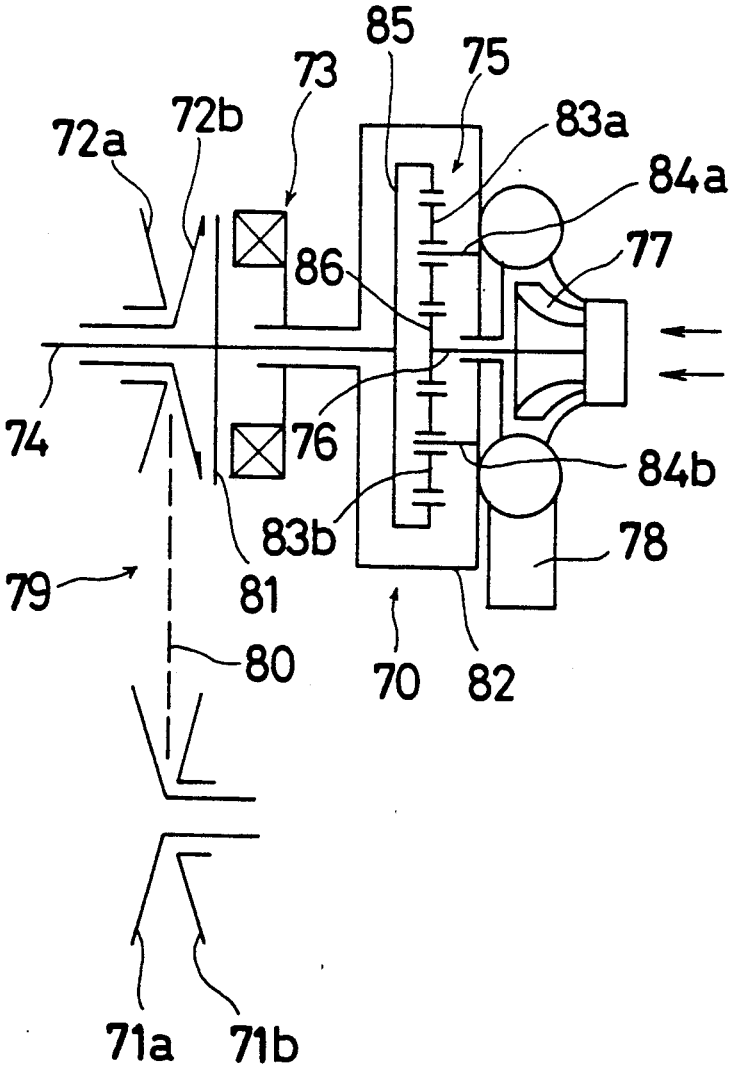
Fig. 6 ( PRIOR ART )
FIG. 6 is a cross-sectional view of a conventional centrifugal

Referring first to FIGS. 1, 5 wherein a centrifugal supercharger 10 is shown. An input shaft 12 supported to a first housing 11 via a bearing 13. An electromagnetic clutch 14 comprises a plate 14*a* fixed to the left end of the input shaft 12, an input pulley 15 and a solenoid coil 14*b*, and is controlled by a central processing unit 54. The input pulley 15 is connected with an output pulley 50 of an engine 51 via a belt member 52. An oil seal 16 is located between the first housing 11 and the input shaft 12 at the left side of the bearing 13.

An output shaft 21 supported to a second housing 22 via a bearing 23. An oil seal 29 is located between the second housing 22 and the output shaft 21 via a plate 40 at the right side of the bearing 23. A compressor rotor 24 is fixed to the right end of the output shaft 21, and is located in a cover 27 fixed with the second housing. A supercharging passage 28 formed in the cover 27 or speed step-up an intake passage 53 of the engine 51. An air cleaner 55 is also located into the intake passage 53.

A third housing 25 is supported between the first housing 11 and the second housing 22 via a snap-ring 26. A first accelerating or speed step-up means 17, second accelerating or speed step-up means 19 and oil-supplying means 30 are located between the input shaft 12 and the output shaft 21.

Figure 2:
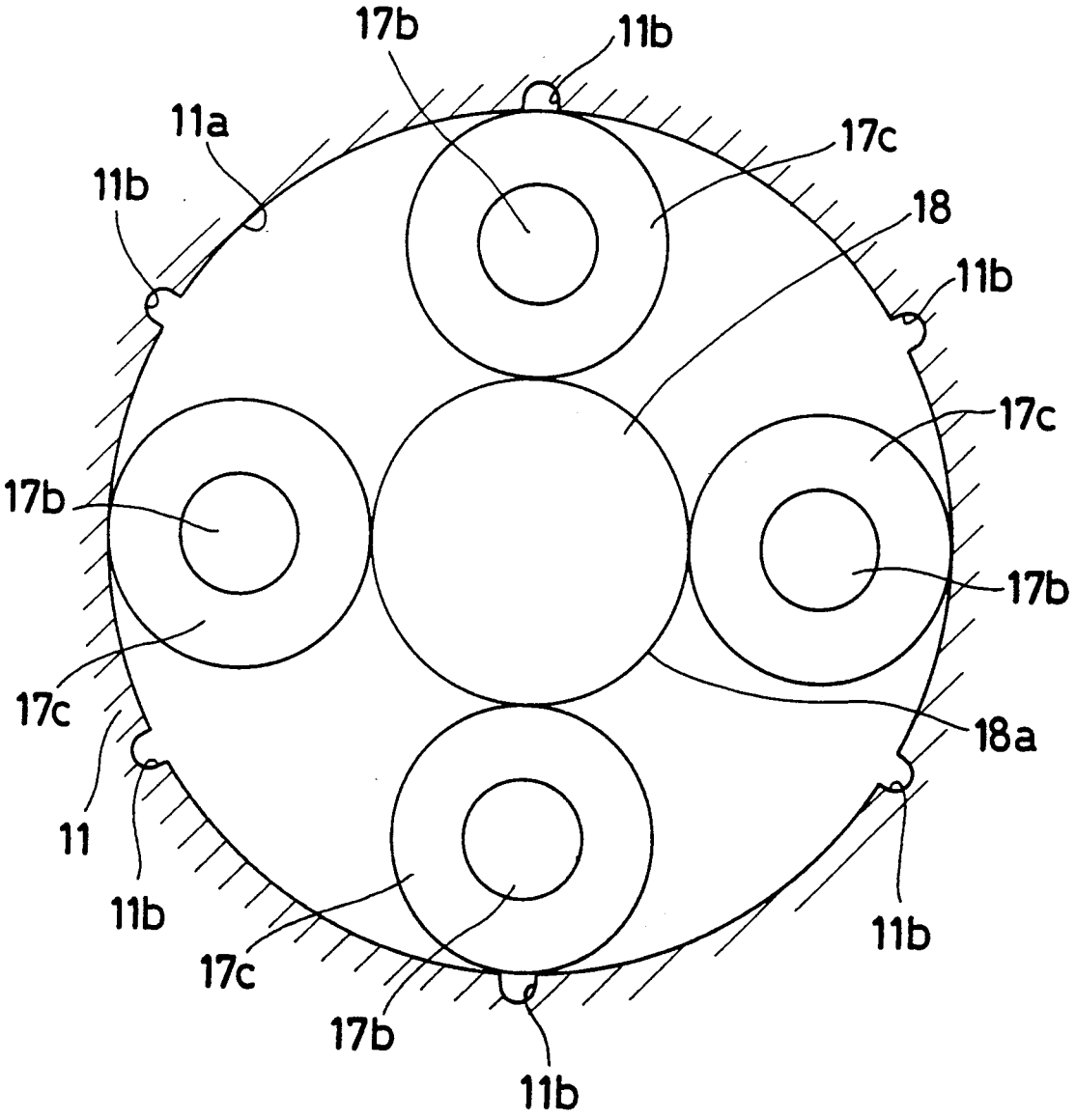
FIG. 2 is an enlarged cross-sectional view of the centrifugal supercharger at line II—II in FIG. 1.

Referring to FIG. 2 in addition to FIG. 1, wherein the first and second accelerating means 17, 19 are explained. Here, a plate 17*a* is fixed to the right end of the input shaft 12. One of the ends of some pins 17*b* (ex. 4 pins) are fixed to the plate 17*a*, and planetary rollers 17*c* are rotatably supported on other ends of the pins 17*b*. One portion of each of the planetary rollers 17*c* is contacted with an inner circumference face 11*a* of the first housing 11, and other portion of each of the planetary rollers 17*c* is contacted with an outer circumference face 18*a* of an output shaft 18. Some oil passages 11*b* are formed in the inner circumference face 11*a*, and form one portion of an oil distributing means 41.

The output shaft 18 also forms an input shaft 20 of the second accelerating means 19. A plate 19*a* is integrated with the output shaft 20. One of the ends of some pins 19*b* (ex. 4 pins) are fixed to the plate 19*a*, and planetary rollers 19*c* are rotatably supported on other ends of the pins 19*b*. One portion of each of the planetary rollers 19*c* is contacted with an inner circumference face of the second housing 22, an other portion of each of the planetary rollers 19*c* is contacted with an outer circumference face of the output shaft 21. Some oil passages 22*a* are formed in the inner circumference face of the second housing 22, and form one portion of the oil distributing means 41. It is noted that the oil passages 11*b*, 22*a* are formed from the contacting portions with the planetary rollers 17*c*, 19*c* to the bearings 13, 23.

Figure 3:
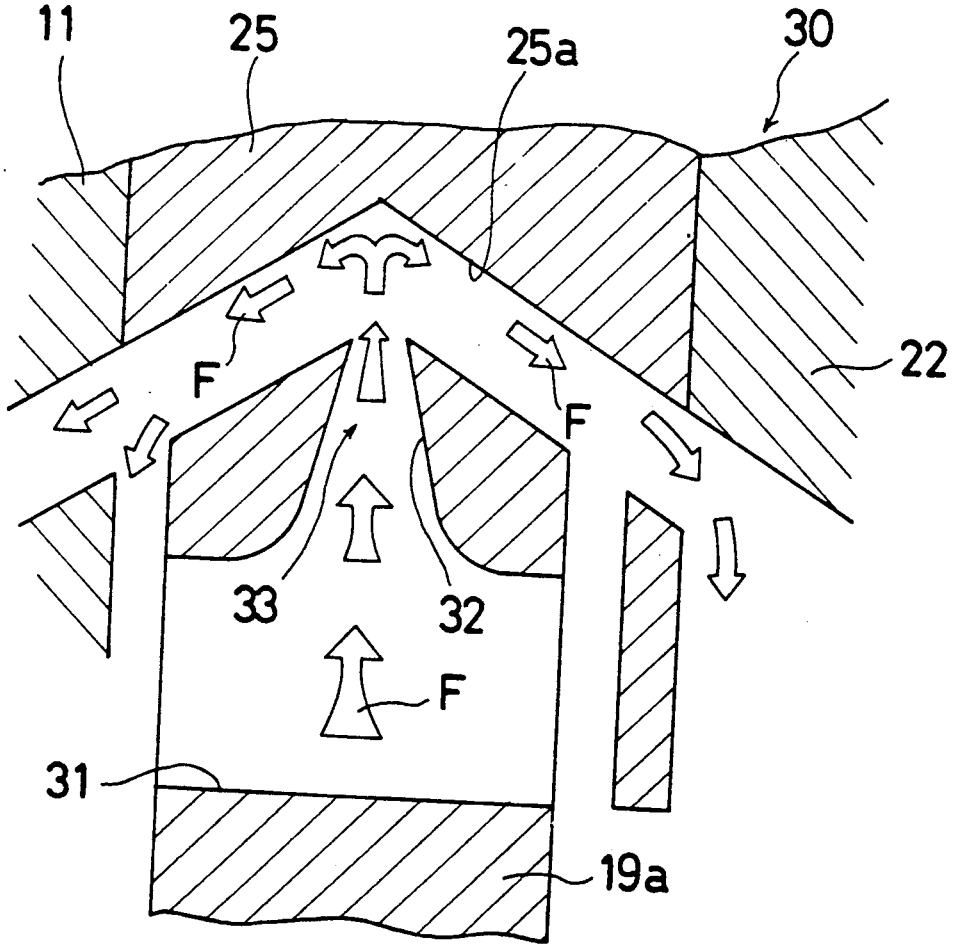
FIG. 3 is an enlarged view of a flowing of a lubricating oil of FIG. 1.
Figure 4:
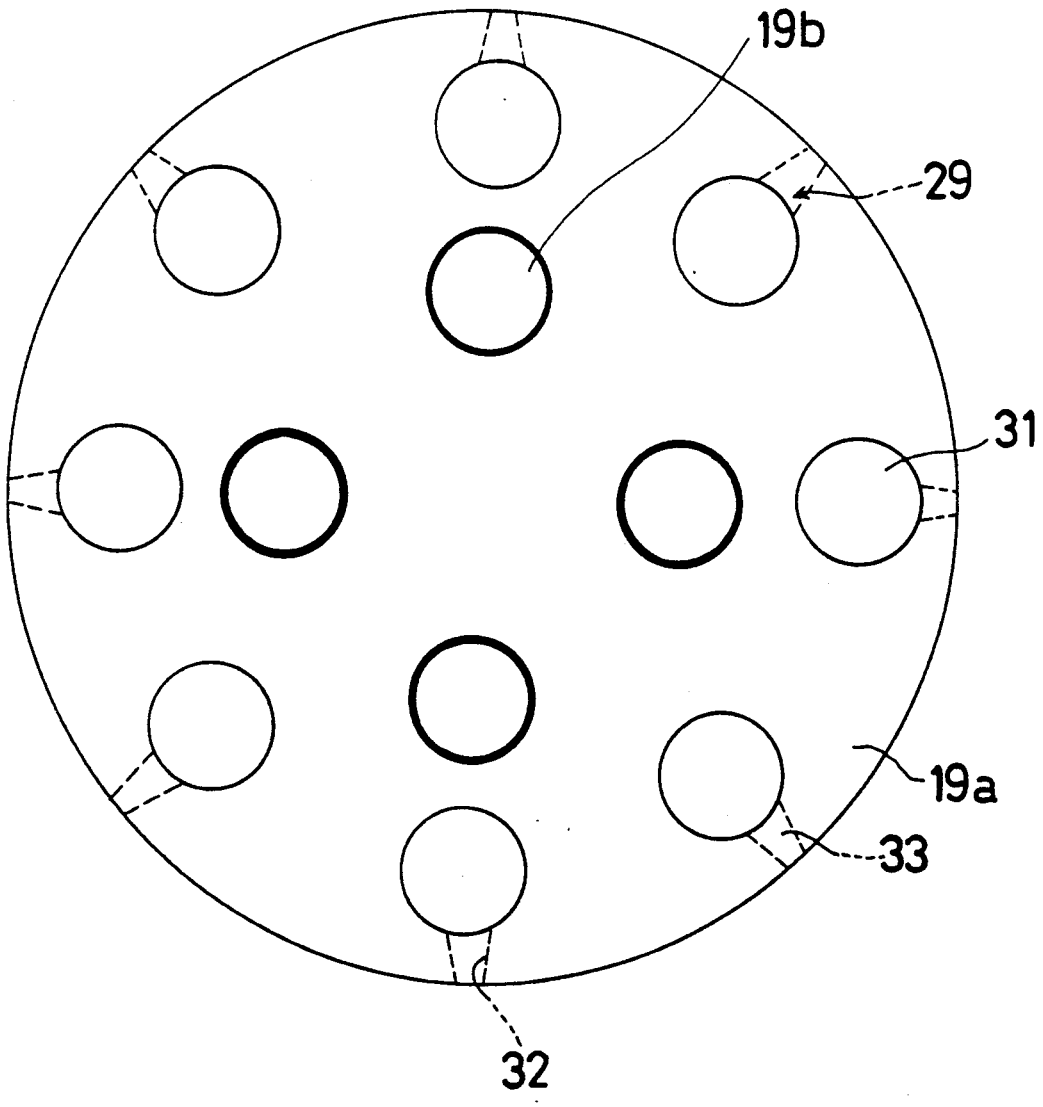
FIG. 4 is an enlarged cross-sectional view of the centrifugal supercharger at line IV—IV in FIG. 1.

Referring to FIGS. 3,4 wherein the oil-supplying means 30 is explained. Some first through holes 31 are formed in the plate 19*a* in the axial direction of the plate 19*a*. Some second through holes 33 are formed in the plate 19*a* from the first through holes 31 to the outer circumference face of the plate 19*a*, and have tapered portions 32. The through hole 33 is smoothly continued with the through hole 31. The outer circumference portion of the plate 19*a* is formed V-shape in section. A V-shaped portion 25*a* is formed on the inner circumference portion of the third housing 25 which is opposite to the outer circumference portion of the plate 19*a*, and forms a distributing means 41. The arrows F in FIG. 3 show the flow of the lubricating oil. The lubricating oil having a high viscosity is stored in a space 42 surrounded by the first, second, third housings 11, 22, 25, and the oil seals 16, 29.

When the above-mentioned centrifugal supercharger 10, is used for supercharging the engine 51, for example, power of the engine 51 is supplied to the input pulley 15. The revolution of the output pulley 50 is stepped-up or accelerated according to the accelerating ratio between the input pulley 15 and the output pulley 50, and is transmitted to the input pulley 15, so that the revolution of the input pulley 15 is 10,000 r.p.m. in maximum.

When the engine 51 needs supercharging, the central processing unit 54 controls the electromagnetic clutch 14. Namely, a current is supplied to the solenoid coil 14*b*. and the plate 14*a* is integrally connected with the input pulley 15. Thus, the input shaft 12 and plate 17*a* rotate with the input pulley 15. Planetary rollers 17*c* rotate around the output shaft 18, so that the revolution of the output shaft 18 is accelerated according to the accelerating ratio between the planetary rollers 17*c* and the output shaft 18.

Similarly, the input shaft 20 and plate 19*a* rotate with the output shaft 18. Planetary rollers 19*c* rotate around the output shaft 21, so that the revolution of the output shaft 21 is accelerated according to the accelerating ratio between the planetary rollers 19*c* and the output shaft 21.

Therefore, the revolution of the output shaft 21 is accelerated as compared to the revolution of the input shaft 12 by the first and second accelerating means 17, 19, so that the compressor rotor 24 is about 200,000~300,000 r.p.m. in maximum, and supercharges intake air for the engine 51.

On the other hand, the lubricating oil having high viscosity is absolutely needed for transmitting the revolution power between the planetary rollers 17*c*, 19*c* and the output shaft 18, 21. Further, the lubricating oil is absolutely needed for the bearings 13, 23 which are rotated at very high revolution. Therefore, the lubricating oil in the lower portion of the space 42 pumped by the through holes 31 in the rotating plate 19*a*, and is sent to the above mentioned portions which need the lubricating oil.

Namely, the oil in the through holes 31 flows to the V-shaped portion 25*a* via the through holes 33 according to the centrifugal force of the plate 19*a*. When the oil flows in the through holes 33, the oil is accelerated due to the tapered portions 32. After that, the oil flows from V-shaped portion 25*a* to the planetary rollers 17*c*, 19*c* and bearings 13, 23 via the oil passages 11*b*, 22*a*.

When the engine 51 does not need supercharging, the central processing unit 54 stops supplying current to the solenoid coil 14*b*.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A centrifugal supercharger comprising:
a housing;
an input shaft rotatably supported on the housing;
a pulley;
an output shaft rotatably supported on the housing;
a compressor rotor fixed to one end of the output shaft;
a cover located around the compressor rotor, and fixed to the housing, and forming a supercharging passage;
a rotating speed step-up means connecting between an other end of the input shaft and an other end of the output shaft;
an oil-supplying means integrated with the accelerating means; and
a distributing means faced with the oil-supplying means, and formed on the housing,
wherein the step-up means comprises:
a) a step-up means input shaft;
b) a plate integrated with the step-up means input shaft;
c) pins fixed to the plate;
d) rollers rotatably supported on the pins and engaging an inner circumference face of the housing; and
e) a step-up means output shaft having an outer circumference face contacted with an outer circumference face of the rollers, wherein the oil-supplying means is formed in the plate.

2. A centrifugal supercharger as set forth in claim 1, wherein the oil-supplying means comprises:
first through holes formed in the plate and extending in an axial direction of the plate; and
second through holes formed in the plate and extending from the first through holes to an outer circumference face of the plate, and having a tapered portion.

3. A centrifugal supercharger as set forth in claim 1, wherein an outer circumference portion of the plate is formed V-shape in section.

4. A centrifugal supercharger as set forth in claim 3, wherein the distributing means comprises:
a V-shaped portion formed on the inner circumference portion of the housing and positioned in facing opposition to the outer circumference portion of the plate; and
an oil passages formed in a portion of the inner circumference face of the body which is contacted with the rollers.

5. A centrifugal supercharger comprising:
a housing;
an input shaft rotatably supported on the housing;

a pulley drivingly connected to one end of the input shaft;

an output shaft rotatably supported on the housing;

a compressor rotor fixed to one end of the output shaft;

a cover located around the compressor rotor, and fixed to the housing, and forming a supercharging passage;

rotating speed step-up means in said housing and connecting between an other end of the input shaft and an other end of the output shaft for stepping up the rotating speed of the output shaft as compared to the input shaft;

centrifugal oil-supplying means integrated with the step-up means for accelerating oil in a radially outward direction in response to the rotation of said step-up means; and a distributing means formed in the housing for receiving and distributing oil accelerated by the oil-supplying means.

6. A centrifugal supercharger as set forth in claim 1, wherein said step-up means includes a plate integrated with the step-up means input shaft, and wherein the oil supplying means is formed in the plate.

* * * * *